US011456514B2

(12) United States Patent
Junttila et al.

(10) Patent No.: US 11,456,514 B2
(45) Date of Patent: Sep. 27, 2022

(54) APPARATUS FOR PROCESSING RADIO FREQUENCY SIGNALS

(71) Applicant: NOKIA SOLUTIONS AND NETWORKS OY, Espoo (FI)

(72) Inventors: Mikko Junttila, Oulu (FI); Antti-Heikki Niemelä, Oulu (FI)

(73) Assignee: NOKIA SOLUTIONS AND NETWORKS OY, Espoo (FI)

( * ) Notice: Subject to any disclaimer, the term of this patent is extended or adjusted under 35 U.S.C. 154(b) by 0 days.

(21) Appl. No.: 16/823,892

(22) Filed: Mar. 19, 2020

(65) Prior Publication Data

US 2020/0303795 A1 Sep. 24, 2020

(30) Foreign Application Priority Data

Mar. 20, 2019 (EP) ..... 19164038

(51) Int. Cl.
*H01P 1/18* (2006.01)
*H01P 3/08* (2006.01)
*H01Q 1/24* (2006.01)

(52) U.S. Cl.
CPC ..... *H01P 1/184* (2013.01); *H01P 3/08* (2013.01); *H01P 3/081* (2013.01); *H01Q 1/246* (2013.01)

(58) Field of Classification Search
CPC . H01P 1/184; H01P 3/08; H01P 3/081; H01Q 1/246
See application file for complete search history.

(56) References Cited

U.S. PATENT DOCUMENTS

| | | | | |
|---|---|---|---|---|
| 7,274,331 | B2 | 9/2007 | Heiniger et al. | |
| 9,325,043 | B2 | 4/2016 | Katipally et al. | |
| 2006/0077098 | A1 | 4/2006 | Zimmerman | |
| 2006/0273864 | A1* | 12/2006 | Zimmerman | H01P 1/184 333/161 |
| 2011/0241954 | A1 | 10/2011 | Le | |

FOREIGN PATENT DOCUMENTS

| | | | |
|---|---|---|---|
| CN | 101123422 | A | 2/2008 |
| CN | 101494309 | A | 7/2009 |
| CN | 101626103 | A | 1/2010 |
| CN | 101820090 | A | 9/2010 |
| CN | 102231451 | A | 11/2011 |

(Continued)

OTHER PUBLICATIONS

Steerable Array Antennas Using a Movable Dielectric Phase Shifter [online] [retrieved Jan. 3, 2019). Retrieved via the Internet: http://labs.ece.uw.edu/ersl/ResearchLinks/SteerableArray.htm (dated at least as early as Jan. 3, 2019). 1 page.

(Continued)

*Primary Examiner* — Samuel S Outten
(74) *Attorney, Agent, or Firm* — Alston & Bird LLP

(57) ABSTRACT

Apparatus for processing radio frequency, RF, signals, wherein said apparatus comprises at least a first transmission line and a second transmission line, and an electrically conductive element that is capacitively coupled with said first transmission line and said second transmission line and that is translationally movably arranged with respect to at least one of said first transmission line and said second transmission line.

18 Claims, 7 Drawing Sheets

(56) References Cited

FOREIGN PATENT DOCUMENTS

| | | | |
|---|---|---|---|
| CN | 203760595 | U | 8/2014 |
| KR | 101831432 | B1 | 2/2018 |
| WO | WO 01/03233 | A1 | 1/2001 |

OTHER PUBLICATIONS

Office Action for Chinese Application No. 202010197695.2 dated Dec. 8, 2021, 4 pages.
Extended European Search Report for EP Application No. 19164038.2 dated Sep. 20, 2019, 8 pages.
Office Action for Chinese Application No. 202010197695.2 dated Jun. 11, 2021, 16 pages.
Office Action for European Application No. 19164038.2 dated Jun. 27, 2022, 8 pages.

* cited by examiner

APPARATUS FOR PROCESSING RADIO FREQUENCY SIGNALS

CROSS-REFERENCE TO RELATED APPLICATIONS

This application claims priority to European Application No. 19164038.2, filed Mar. 20, 2019, the entire contents of which are incorporated herein by reference.

FIELD OF THE INVENTION

The disclosure relates to an apparatus for processing radio frequency, RF, signals.

The disclosure further relates to a method of processing radio frequency, RF, signals.

BACKGROUND

Apparatus for processing RF signals may e.g. be used for processing RF signals that are provided for transmission via an antenna.

SUMMARY

Some embodiments feature an apparatus for processing radio frequency, RF, signals, wherein said apparatus comprises at least a first transmission line and a second transmission line, and an electrically conductive element that is capacitively coupled with said first transmission line and said second transmission line and that is translationally movably arranged with respect to at least one of said first transmission line and said second transmission line. This enables to process RF signals with increased flexibility, i.e. for distributing RF signals from a source (e.g., a power amplifier) to one or more sinks (e.g., ports of an antenna (system)) and/or influencing a phase of said RF signals.

According to further exemplary embodiments, said apparatus may be used for processing RF signals in a transmitter and/or a transmitter branch of an RF device. According to further exemplary embodiments, said apparatus may be used for processing RF signals in a receiver and/or a receiver branch of an RF device.

According to further exemplary embodiments, said electrically conductive element comprises a port for receiving an input signal, i.e. an RF input signal, which may also be denoted as an input port according to further exemplary embodiments. This way, said electrically conductive element may distribute said input signal to said transmission lines via said capacitive coupling. However, according to further exemplary embodiments, said port of said electrically conductive element may also be configured to output an RF signal, e.g. an RF signal provided to the apparatus at a further port.

According to further exemplary embodiments, at least one of said transmission lines comprises at least one port for output of at least one respective output signal depending on said input signal, which may also be denoted as "output port(s)" according to further exemplary embodiments. As an example, said input signal may be provided to said electrically conductive element, which couples respective portions of said input signal via said capacitive coupling into said transmission lines, and, according to further exemplary embodiments, respective end sections of said transmission lines may comprise ports for providing these signal portions to at least one external device, i.e. an input port of an antenna (system). In this example, said ports may be used as output ports.

However, according to further exemplary embodiments, said at least one port of said at least one transmission line may also be configured to receive an RF signal, e.g. an RF signal provided to the apparatus at said at least one port. According to further exemplary embodiments, said apparatus comprises at least one further transmission line (i.e., three transmission lines), wherein said electrically conductive element is (also) capacitively coupled with said at least one further transmission line, i.e. with all of said three transmission lines.

According to further exemplary embodiments, more than three transmission lines may also be provided, and in these cases, it is also possible that said electrically conductive element is capacitively coupled to a plurality of these more than three transmission lines, or to all of these transmission lines.

According to further exemplary embodiments, said electrically conductive element is translationally movably arranged with respect to all transmission lines. As an example, the transmission lines may be arranged on a (common) carrier element (wherein each of said transmission lines may comprise its own substrate, cf. further below), and said electrically conductive element is translationally movably arranged relative to said carrier element (and thus also relative to all transmission lines). In other words, the electrically conductive element may perform a translatory movement relative to said transmission lines. By moving (manually and/or by means of a drive) said electrically conductive element with respect to the transmission lines, a signal phase of the RF signal coupled from said electrically conductive element into the respective transmission line may be shifted, so that the apparatus according to the embodiments may advantageously be used as a phase shifter for RF signals.

According to further exemplary embodiments, at least one of said transmission lines comprises or is a microstrip line and/or a stripline, which enables a particularly cost effective implementation and reliable operation.

According to further exemplary embodiments, at least two of said transmission lines comprise different properties with respect to at least one of the following elements: a) a relative permittivity of a substrate, b) a geometry. This way, a degree of phase shift effected by the movement of the electrically conductive element relative to the transmission line may be influenced.

As an example, according to further exemplary embodiments, different transmission lines, which may e.g. be provided in the form of microstrip lines, may comprise respective (dielectric) substrates, wherein the relative permittivity of said respective substrates comprises different values.

As a further example, a dielectric substrate of a first transmission line or microstrip line may comprise a first value of said relative permittivity, e.g. 1.0 (e.g., air), whereas a dielectric substrate of a second transmission line or microstrip line may comprise a second, different value of said relative permittivity, e.g. 5.7.

According to further exemplary embodiments, at least one of said transmission lines may comprise a (preferably low-loss) dielectric material, e.g. a dielectric material a relative permittivity of which may be controlled, e.g. during a manufacturing process. This way, different transmission lines with different properties regarding an effect on the phase shift of an input signal may be obtained according to further exemplary embodiments.

According to further exemplary embodiments, said electrically conductive element comprises at least one impedance transformer, whereby a distribution of signal energy from of the input signal to various branches of said apparatus may be controlled, wherein said branches are characterized by a respective one of said transmission lines.

According to further exemplary embodiments, a conductor of at least one of said transmission lines is embedded into a dielectric substrate, preferably such that it comprises a predetermined distance from a surface of the substrate (i.e., embedding depth) on which e.g. the electrically conductive element may be guided according to further exemplary embodiments. This way, the degree of said capacitive coupling between the electrically conductive element and the respective transmission line may be precisely controlled.

Alternatively, according to further exemplary embodiments, one or more spacers may be provided at said electrically conductive element which may make sliding contact when said electrically conductive element is translationally moved with respect to said transmission lines. According to further exemplary embodiments, said one or more spacers may comprise dielectric material, so that the spacers may e.g. directly contact a conductor of the transmission line.

According to further exemplary embodiments, at least one of said transmission lines and/or a conductor of at least one of said transmission lines comprises a curved or meandered section. This way, a sensitivity of the phase shift effected by translational movement of the electrically conductive element with respect to the transmission line(s) may be increased (as compared to a straight, linear transmission line).

According to further exemplary embodiments, said transmission lines are arranged in a same first virtual plane, and said electrically conductive element is arranged within a second virtual plane which is at least substantially parallel (difference of surface normals of said virtual planes less than 10 degrees, preferably less than 5 degrees) to said first virtual plane.

Further exemplary embodiments relate to an antenna or antenna system comprising at least one apparatus according to the embodiments.

Further exemplary embodiments relate to a use of the apparatus according to the embodiments for applying a phase shift to a radio frequency, RF, signal.

Further exemplary embodiments relate to a method of operating an apparatus for processing radio frequency, RF, signals, wherein said apparatus comprises at least a first transmission line and a second transmission line, and an electrically conductive element that is capacitively coupled with said first transmission line and said second transmission line and that is translationally movably arranged with respect to at least one of said first transmission line and said second transmission line, said method comprising: providing an RF signal as an input signal to said electrically conductive element, and moving said electrically conductive element relative to said at least one of said first transmission line and said second transmission line.

Further exemplary embodiments relate to a use of the apparatus according to the embodiments for distributing an RF input signal to a plurality of sinks while applying a phase shift to said RF input signal.

BRIEF DESCRIPTION OF THE FIGURES

Further features, aspects and advantages of the illustrative embodiments are given in the following detailed description with reference to the drawings in which.

DESCRIPTION OF EXEMPLARY EMBODIMENTS

Figure 1:
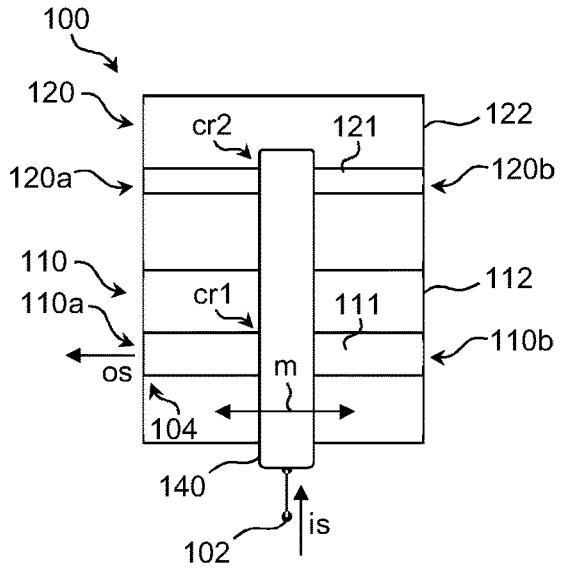
FIG. 1 schematically depicts a top view of an apparatus according to exemplary embodiments, FIG. 2 schematically depicts a top view of an apparatus according to further exemplary embodiments, FIG. 3 schematically depicts a top view of an apparatus according to further exemplary embodiments, FIG. 4A schematically depicts a side view of an apparatus according to further exemplary embodiments, FIG. 4B schematically depicts a side view of an apparatus according to further exemplary embodiments, FIG. 5 schematically depicts a simplified flow-chart of a method according to further exemplary embodiments, FIG. 6 schematically depicts a top view of an apparatus according to further exemplary embodiments, FIG. 7A, 7B, 7C each schematically depict a top view of the apparatus according to FIG. 6 in a different operational state, FIG. 8 schematically depicts a return loss over frequency according to further exemplary embodiments, FIG. 9A, 9B, 9C each schematically depict scattering parameters (forward gain) over frequency for different operational states of the apparatus according to FIG. 6, FIG. 10A, 10B, 10C each schematically depict a phase over frequency for different operational states of the apparatus according to FIG. 6, FIG. 11A, 11B, 11C each schematically depict an antenna characteristic as obtained by different operational states of the apparatus according to FIG. 6, FIG. 12 schematically depicts a simplified block diagram of an antenna according to further exemplary embodiments, and FIG. 13 schematically depicts a simplified block diagram of a base station according to further exemplary embodiments.

FIG. 1 schematically depicts a top view of an apparatus 100 according to exemplary embodiments. The apparatus 100 may be used for processing radio frequency, RF, signals as explained in detail below.

The apparatus 100 comprises at least a first transmission line 110 and a second transmission line 120, and an electrically conductive element 140 that is capacitively coupled with said first transmission line 110 and said second transmission line 120, cf. the first coupling region cr1, where element 140 "intersects" (as seen in projection of the top view of FIG. 1) a conductor 111 of said first transmission line 110 and the second coupling region cr2, where element 140 "intersects" a conductor 121 of said second transmission line 120. In and/or around these "intersections", RF energy may be exchanged between element 140 and a respective conductor 111, 121 of the transmission lines 110, 120.

Further, said electrically conductive element 140 is translationally movably (cf. double arrow m) arranged with respect to at least one of said first transmission line 110 and said second transmission line 120, preferably with respect to both transmission lines 110, 120. This enables to process RF signals with increased flexibility, i.e. for distributing RF signals from a source (not shown, e.g., a power amplifier) to one or more sinks (not shown, e.g., ports of an antenna (system)) and/or influencing a phase of said RF signals.

According to further exemplary embodiments, said electrically conductive element 140 comprises a port 102 for receiving an input signal is, i.e. an RF input signal, wherein said port 102 may at least temporarily operate as an input port. This way, said electrically conductive element 140 may distribute said input signal is (or respective portions thereof) to said transmission lines 110, 120 via said capacitive coupling cr1, cr2. In this respect, an exemplary output signal os is depicted by FIG. 1 which may be obtained at a first axial end section 110*a* of said first transmission line 110, said first axial end section 110*a* exemplarily forming a port 104 for signal output of said apparatus 100, wherein said port 104 may at least temporarily operate as an output port. Similarly, further output signals (not shown) may be obtained at a second axial end section 110*b* of the first transmission line 110 and at respective axial end sections 120*a*, 120*b* of said second transmission line 120.

Moreover, when supplying said input signal is to said input port 102, the phase of respective output signals os may be influenced by moving said electrically conductive element 140 with respect to said transmission lines 110, 120, e.g. in a horizontal direction m of FIG. 1.

According to further exemplary embodiments, at least one of said transmission lines 110 comprises (or constitutes) at least one port 104 for output of at least one respective output signal os depending on said input signal is. In this respect, said at least one port 104 is exemplarily termed "output port" for the further exemplary explanations. However, according to further exemplary embodiments, apparatus 100 may also receive an RF signal at said port 104 and/or output an RF signal at said port 102.

As mentioned above, according to exemplary embodiments, said input signal may be provided to said electrically conductive element 140 at the input port 102, and the electrically conductive element 140 couples respective portions of said input signal is via said capacitive coupling cr1, cr2 into said transmission lines 110, 120, and, according to further exemplary embodiments, respective end sections 110*a*, 110*b*, 120*a*, 120*b* of said transmission lines 110, 120 may comprise output ports 104 for providing these signal portions to at least one external device, i.e. an input port 202 (FIG. 12) of an antenna (system) 200.

Figure 2:
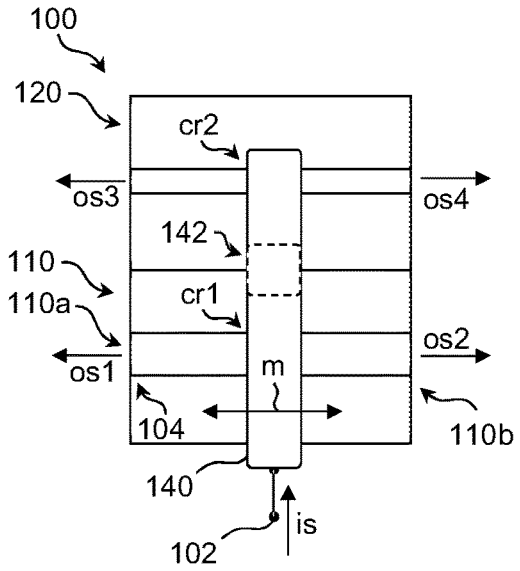

In this regard, FIG. 2 depicts a configuration where the opposing axial end sections 110*a*, 110*b*, 120*a*, 120*b* of both transmission lines 110, 120 are used as output ports, whereby respective output signals os1, os2, os3, os4 may be obtained depending on said input signal is. Note that the phase of the output signals os1, os2, os3, os4 may advantageously be influenced by moving m the element 140 with respect to said transmission lines 110, 120.

According to further exemplary embodiments, said electrically conductive element 140, cf. FIG. 2, comprises at least one impedance transformer 142, whereby a distribution of signal energy from the input signal is to various branches of said apparatus 100 may be controlled, wherein said branches are characterized by a respective one of said transmission lines 110, 120. In other words, by choosing parameters of the impedance transformer 142, a distribution of energy of said input signal is to said transmission lines 110, 120 may be controlled.

According to further exemplary embodiments, at least one of said transmission lines 110, 120 comprises or is a microstrip line, which enables a particularly cost effective implementation and reliable operation.

Figure 3:
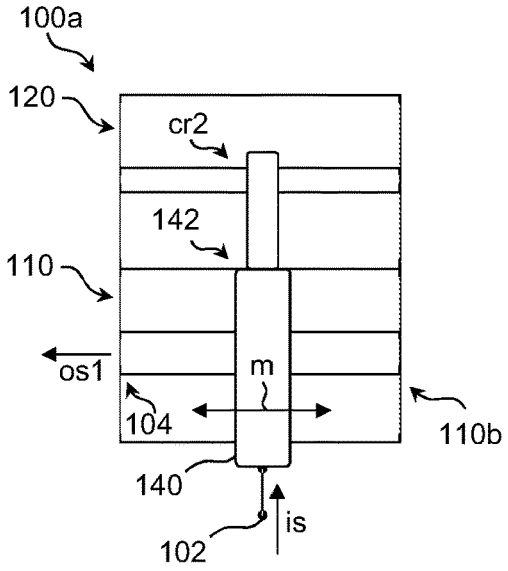

FIG. 3 schematically depicts a top view of an apparatus 100*a* according to further exemplary embodiments. In these embodiments, the impedance transformer 142 is exemplarily implemented in form of a contour discontinuity (presently effected by a stepwise change of the width along a longitudinal axis) of the electrically conductive element 140.

Figure 4A:
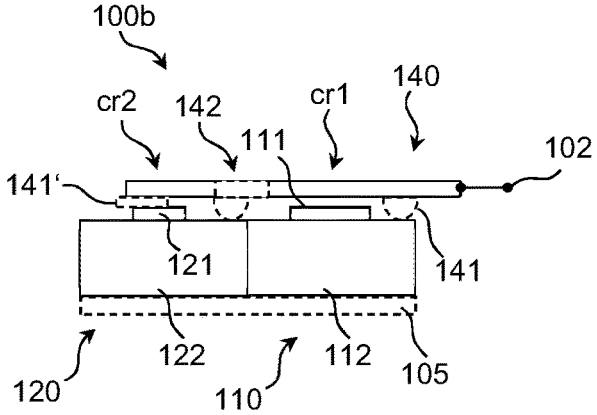

FIG. 4A schematically depicts a side view of an apparatus 100*b* according to further exemplary embodiments. It can be seen that the first transmission line 110 (cf. FIG. 1) comprises a substrate 112 (FIG. 4A) and a conductor 111 arranged on a top surface of said substrate 112. Similarly, the second transmission line 120 (FIG. 1) comprises a substrate 122 (FIG. 4A) and a conductor 121 arranged on a top surface of said substrate 122.

According to further exemplary embodiments, the electrically conductive element 140 comprises one or more spacers 141 which may make sliding contact with said surface of the substrate(s) 112, 122 when said electrically conductive element 140 is translationally moved with respect to said transmission lines 110, 120 (perpendicular to the drawing plane of FIG. 4A).

According to further exemplary embodiments, said one or more spacers 141 may comprise dielectric material, so that the spacers may e.g. directly contact a conductor 111, 121 of the transmission line(s) 110, 120. This is exemplarily depicted by the dashed rectangle 141' of FIG. 4A. I.e., according to further exemplary embodiments, at least one spacer 141' may be provided alternatively or additionally to the spacer(s) 141. Spacer 141' may e.g. be used to provide mechanical support to the electrically conductive element 140 and/or capacitance adjustment between components 140, 121. According to some embodiments, spacer 141' may be attached to the electrically conductive element 140.

According to further exemplary embodiments, the transmission lines 110, 120 (or their substrate(s) 112, 122) may be arranged on a (common) carrier element 105, and said electrically conductive element 140 may be translationally movably arranged relative to said carrier element 105 (and thus also relative to all transmission lines). By moving said electrically conductive element with respect to the transmission lines, a signal phase of the RF signal coupled from said electrically conductive element 140 into the respective transmission line 110, 120 may be shifted, so that the apparatus according to the embodiments may advantageously be used as a phase shifter for RF signals is, os, especially also as a phase shifter for multiband and/or wideband operation.

According to further exemplary embodiments, the optional carrier 105 may also form a ground plane or generally an electrically conductive surface a predetermined electrical (reference) potential, such as ground potential, may be applied to.

Figure 4B:
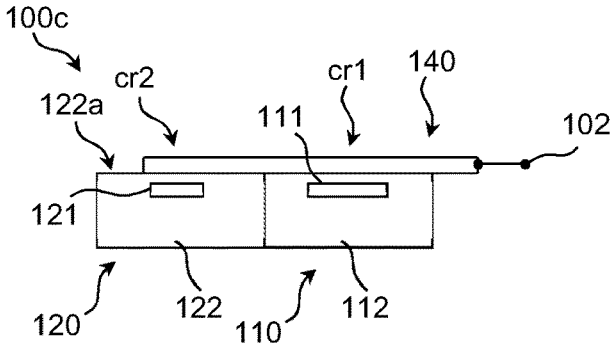

FIG. 4B schematically depicts a side view of an apparatus 100*c* according to further exemplary embodiments. In these exemplary embodiments, a conductor 111, 121 of at least one of said transmission lines 110, 120 is embedded into the dielectric substrate 112, 122, preferably such that it comprises a predetermined distance from a surface 122*a* of the substrate (i.e., embedding depth) on which e.g. the electrically conductive element 140 may be guided according to further exemplary embodiments. This way, the degree of said capacitive coupling between the electrically conductive element 140 and the respective transmission line 110, 120 may be precisely controlled, and the conductors 111, 121 are protected from environmental influences.

Figure 5:
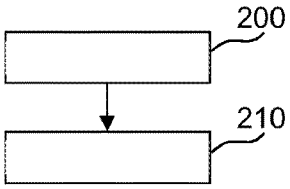

Further exemplary embodiments relate to a method of operating an apparatus according to the embodiments, said method comprising, cf. the flow chart of FIG. 5: providing 200 an RF signal as an input signal is (FIG. 1) to said electrically conductive element 140, and moving 210 (FIG. 5) said electrically conductive element 140, also cf. double arrow m of FIG. 1, relative to said at least one of said first transmission line 110 and said second transmission line 120.

Figure 6:
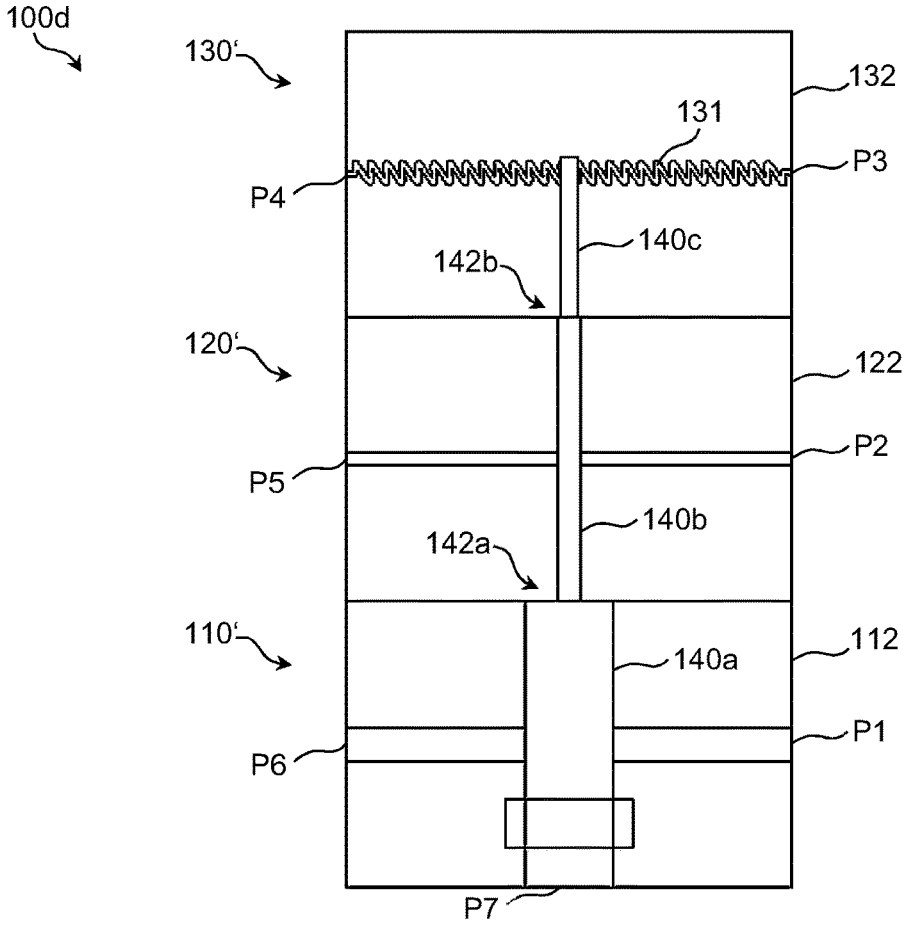

According to further exemplary embodiments, said apparatus 100*d*, cf. the top view of FIG. 6, comprises at least one further transmission line 130', i.e., three transmission lines 110', 120', 130', wherein said electrically conductive element 140 is (also) capacitively coupled with said at least one further transmission line 130', i.e. with all of said three transmission lines 110', 120', 130'.

According to further exemplary embodiments, more than three transmission lines may also be provided, and in these cases, it is also possible that said electrically conductive element is capacitively coupled to a plurality of these more than three transmission lines, or to all of these transmission lines.

Returning to FIG. 6, the first transmission line 110' comprises two output ports P1, P6 characterized by respective axial end sections of said transmission line 110', the second transmission line 120' also comprises two output ports P2, P5 characterized by respective axial end sections of said transmission line 120', and the third transmission line 130' also comprises two output ports P3, P4 characterized by respective axial end sections of said transmission line 110'. In other words, an input signal is provided to the input port P7 at the electrically conductive element 140 of the apparatus 100*d* of FIG. 6 may be distributed to said six output ports P1, P2, P3, P4, P5, P6.

The above explanation of the ports P1, . . . , P7 exemplarily considers using the ports P1, . . . , P6 at least temporarily as output ports and port P7 at least temporarily as input port. However, according to further exemplary embodiments, any of said ports P1, . . . , P7 may be used for receiving and/or transmitting respective RF signal(s). As a further example, ports P1, . . . , P6 may be used as input ports, i.e. for receiving a plurality of respective RF signals (i.e., from different antenna elements of an RF antenna), and port P7 may be provided to output an RF signal depending on said plurality of RF input signals received at said input ports P1, . . . , P6.

For the further exemplary explanations, however, it is referred to cases where said input signal is provided to port P7 and is distributed via the apparatus 100*d* to the ports P1, . . . , P6 with a respective phase shift.

According to further exemplary embodiments, the electrically conductive element 140 comprises three different sections 140*a*, 140*b*, 140*c*, wherein width discontinuities between adjacent sections 140*a*, 140*b*; 140*b*, 140*c* implement a respective impedance transformer 142*a*, 142*b* that controls energy distribution between said transmission lines 110', 120', 130' via said electrically conductive element 140.

According to further exemplary embodiments, at least two of said transmission lines 110', 120', 130' (FIG. 6) comprise different properties with respect to at least one of the following elements: a) a relative permittivity of a substrate 112, 122, 132, b) a geometry (e.g., width of the conductor(s). This way, a degree of phase shift effected by the movement of the electrically conductive element 140 relative to the transmission line may be influenced.

As an example, according to further exemplary embodiments, different transmission lines, which may e.g. be provided in the form of microstrip lines, may comprise respective (dielectric) substrates, wherein the relative permittivity of said respective substrates comprises different values.

As a further example, a dielectric substrate 112 of a first transmission line 110' or microstrip line may comprise a first value of said relative permittivity, e.g. 1.0 (e.g., air), whereas a dielectric substrate 122 of a second transmission line 120' or microstrip line may comprise a second, different value of said relative permittivity, e.g. 5.7, and a dielectric substrate 132 of a third transmission line 130' or microstrip line may comprise a third, different value of said relative permittivity, e.g. 12. Similar observations also apply to the embodiments of FIG. 1, 2, 3, 4A, 4B.

According to further exemplary embodiments, at least one of said transmission lines 110', 120', 130' (FIG. 6) may comprise a (preferably low-loss) dielectric material 112, 122, 132, particularly a dielectric material a relative permittivity of which may be selected and/or controlled, e.g. during a manufacturing process. This way, different transmission lines 110', 120', 130' with different properties regarding an effect on the phase shift of an input signal may be obtained according to further exemplary embodiments.

According to further exemplary embodiments, at least one of said transmission lines and/or a conductor of at least one of said transmission lines comprises a curved or meandered section, cf. conductor 131 of FIG. 6. This way, a sensitivity of the phase shift effected by translational movement of the electrically conductive element 140 with respect to the transmission line(s) 130' may be increased (as compared to a straight, linear transmission line 110', 120').

According to further exemplary embodiments, said electrically conductive element 140 extends with its longitudinal axis perpendicularly to a respective longitudinal axis of at least one transmission line (which is e.g. horizontal in FIG. 6). According to further exemplary embodiments, a direction of said translatory movement m (FIG. 1) of said electrically conductive element 140 is parallel to a respective longitudinal axis of at least one transmission line.

According to further exemplary embodiments, said transmission lines 110', 120', 130' are arranged in a same first virtual plane, and said electrically conductive element 140 is arranged within a second virtual plane which is at least substantially parallel (difference of surface normals of said virtual planes less than 10 degrees, preferably less than 5 degrees) to said first virtual plane.

Figure 7A:
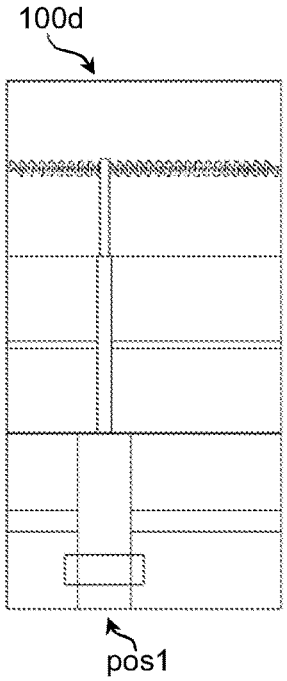
Figure 7B:
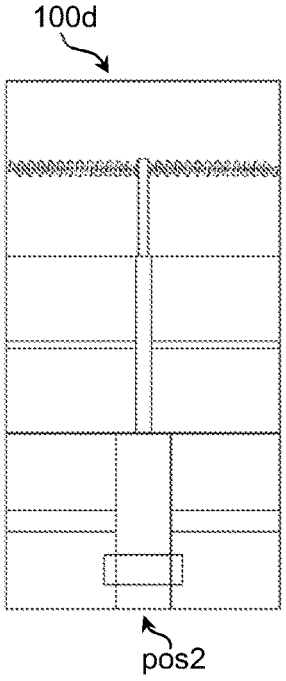
Figure 7C:
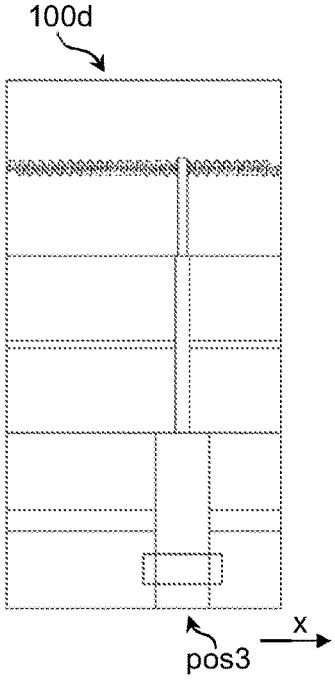

FIG. 7A, 7B, 7C each schematically depict a top view of the apparatus 100*d* according to FIG. 6 in a different operational state. In FIG. 7A, the electrically conductive element 140, which may also be denoted as "slider", is in a first (presently, left) position pos1 with reference to a coordinate axis x, which is horizontal in FIG. 7A to 7C. In FIG. 7B, the slider 140 is in a second (presently, middle) position pos2, and in FIG. 7C, the slider 140 is in a third (presently, right) position. According to further exemplary embodiments, the slider 140 may also be moved to further positions not depicted by FIG. 7, e.g. intermediate positions between pos1, pos or pos2, pos3, or further positions, e.g. "beyond" pos1 or pos 3.

Figure 8:
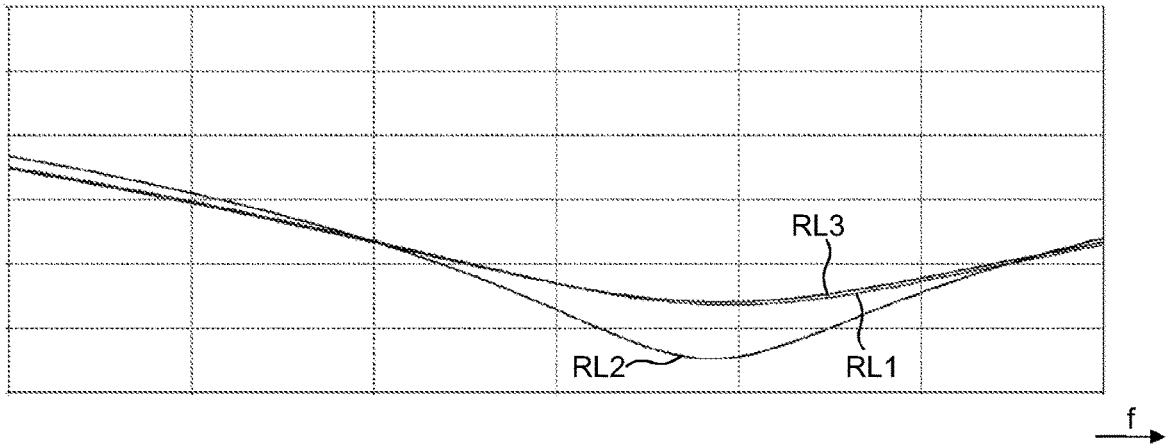

FIG. 8 schematically depicts a return loss (magnitude) over frequency f (in an exemplary frequency range between 1.9 GHz and 2.2 GHz) for the apparatus 100*d* of FIG. 6 according to further exemplary embodiments, wherein curve RL1 corresponds to the "left" slider position pos1 of FIG. 7A, wherein curve RL2 corresponds to the "middle" slider position pos2 of FIG. 7B, and wherein curve RL3 corresponds to the "right" slider position pos3 of FIG. 7C.

Figure 9A:
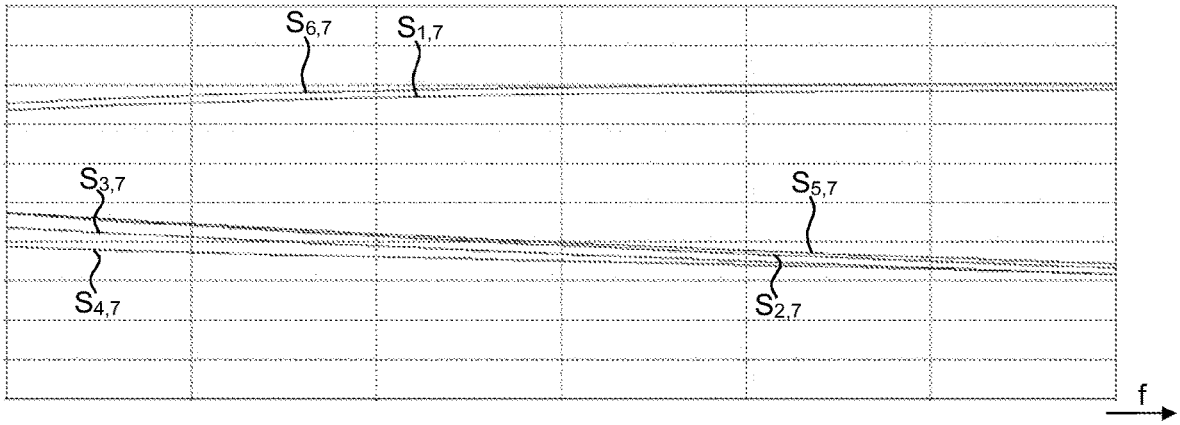
Figure 9B:
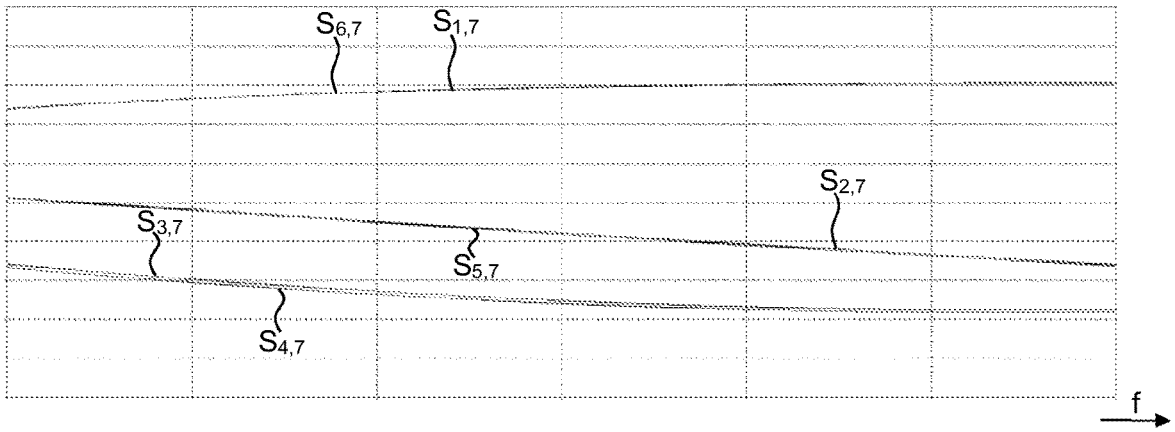
Figure 9C:
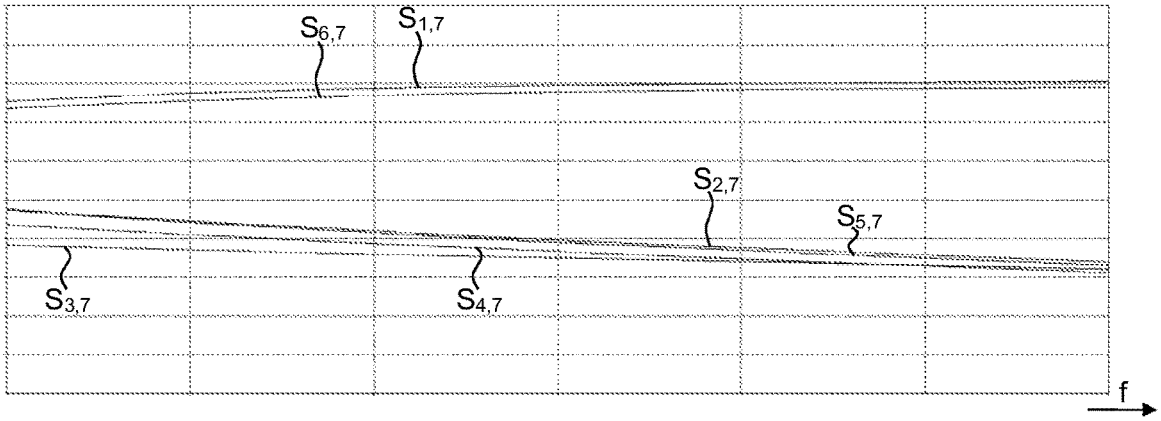

FIG. 9A, 9B, 9C each schematically depict scattering parameters (forward gain, magnitude) $S_{1,7}$, $S_{2,7}$, . . . , $S_{6,7}$ over frequency f (in an exemplary frequency range between 1.9 GHz and 2.2 GHz) for different operational states pos1, pos2, pos3 of the apparatus 100*d* according to FIGS. 6 and 7, wherein FIG. 9A corresponds to the "left" slider position pos1 of FIG. 7A, wherein FIG. 9B corresponds to the "middle" slider position pos2 of FIG. 7B, and wherein FIG. 9C corresponds to the "right" slider position pos3 of FIG. 7C.

Figure 10A:
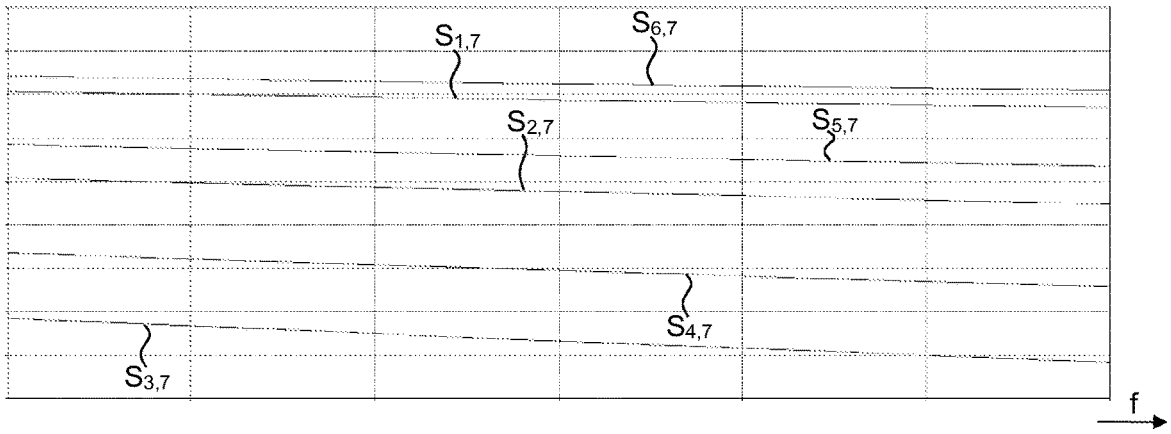
Figure 10B:
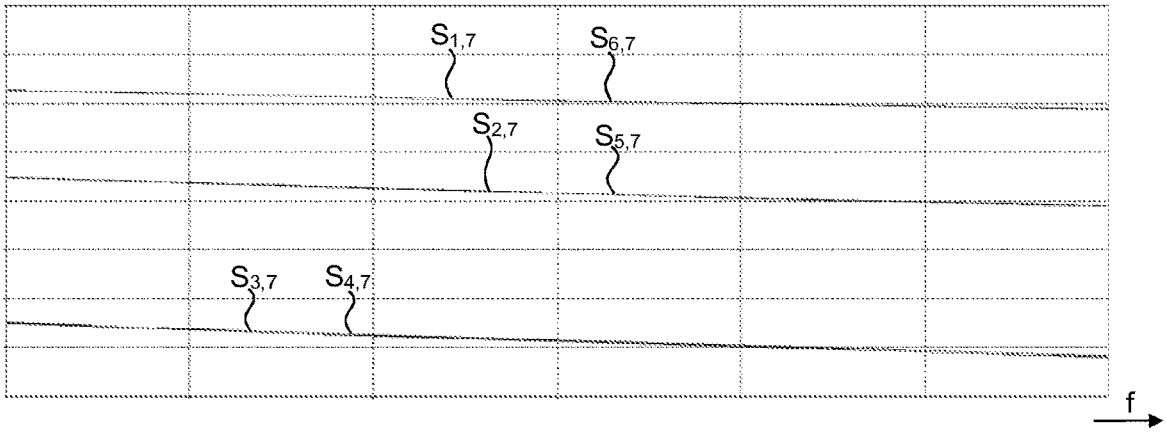
Figure 10C:
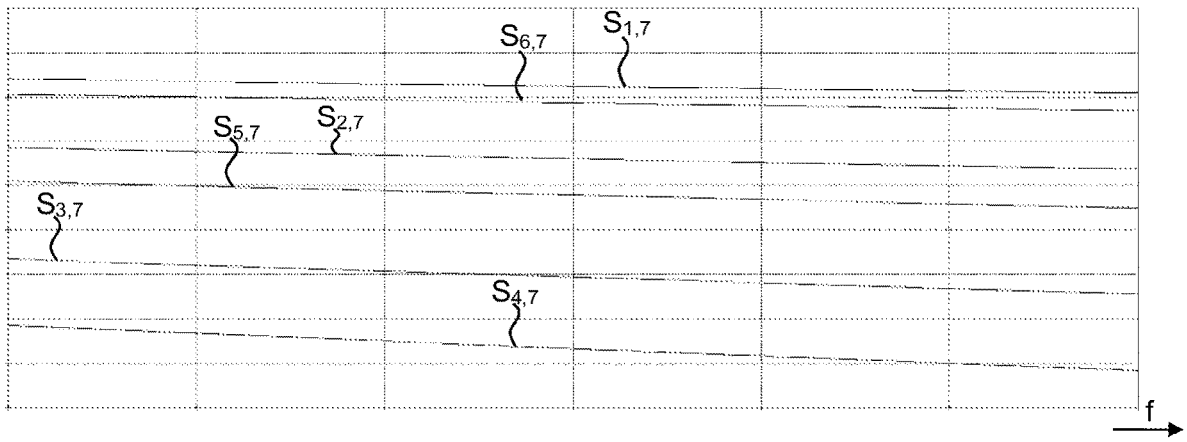

FIG. 10A, 10B, 10C each schematically depict a phase of scattering parameters (forward gain) $S_{1,7}, S_{2,7}, \ldots, S_{6,7}$ over frequency f (in an exemplary frequency range between 1.9 GHz and 2.2 GHz) for different operational states of the apparatus 100*d* according to FIGS. 6, 7, wherein FIG. 10A corresponds to the "left" slider position post of FIG. 7A, wherein FIG. 10B corresponds to the "middle" slider position pos2 of FIG. 7B, and wherein FIG. 10C corresponds to the "right" slider position pos3 of FIG. 7C.

Figure 11A:
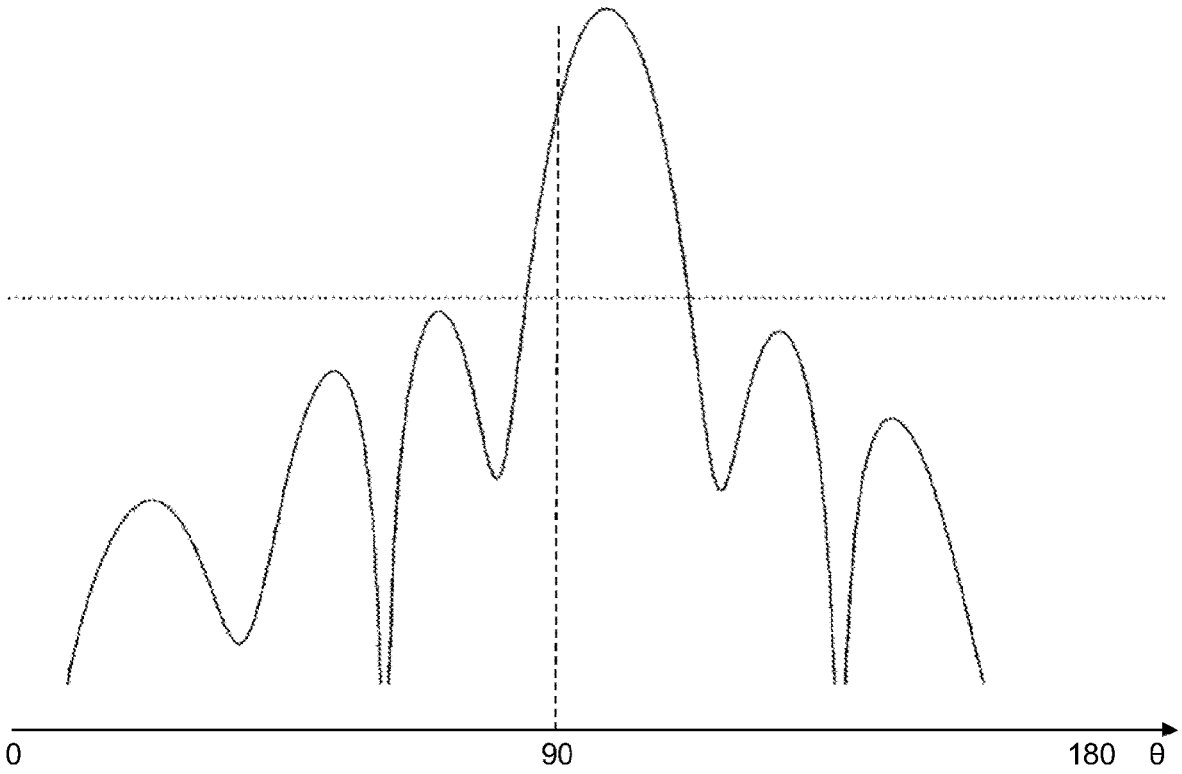
Figure 11B:
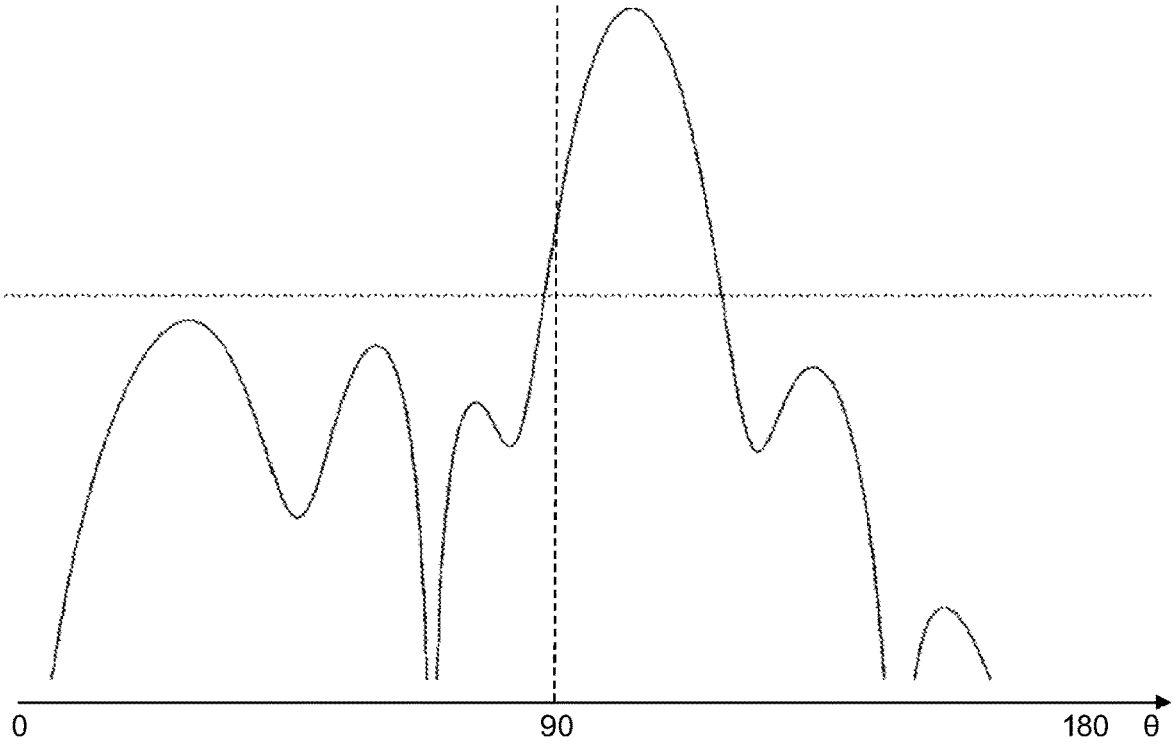
Figure 11C:
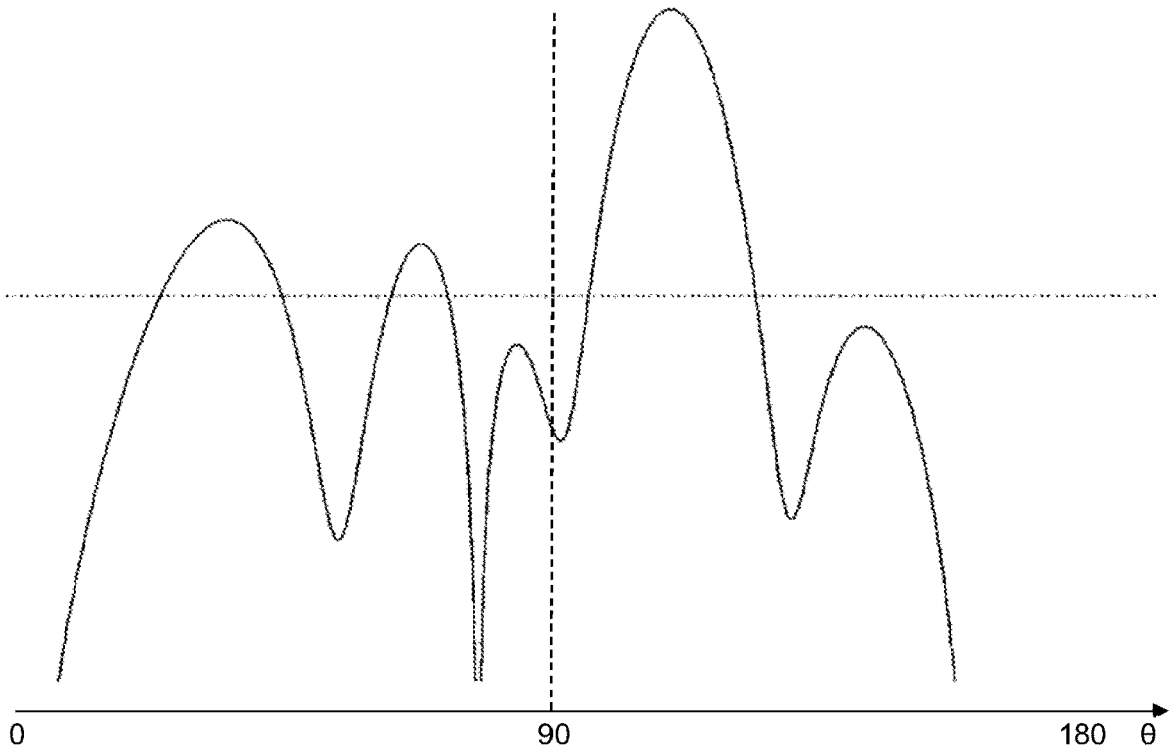

FIG. 11A, 11B, 11C each schematically depicts an antenna characteristic (gain over vertical angle θ) as obtained by different operational states of the apparatus 100*d* according to FIGS. 6, 7, when using the apparatus 100*d* for supplying respective input ports 202 (FIG. 12) of an antenna system 200 with phase shifted output signals as may be obtained at the output ports P1, P2, P3, P4, P5, P6 of the apparatus 100*d*, cf. FIG. 6 when supplying an RF input signal is to the input port P7. In this regard, the antenna characteristic of FIG. 11A corresponds to a first state of the slider 140 (FIG. 6), the antenna characteristic of FIG. 11B corresponds to a second state of the slider 140 (FIG. 6), and the antenna characteristic of FIG. 11C corresponds to a third state of the slider 140 (FIG. 6). It can be seen that by moving the slider 140 into different states, the so obtained phase shift of output signals provided at the output ports P1 to P6 of the apparatus 100*d* may advantageously be used for antenna beam pattern control of an antenna system, presently e.g. for controlling a downtilt angle.

Figure 12:
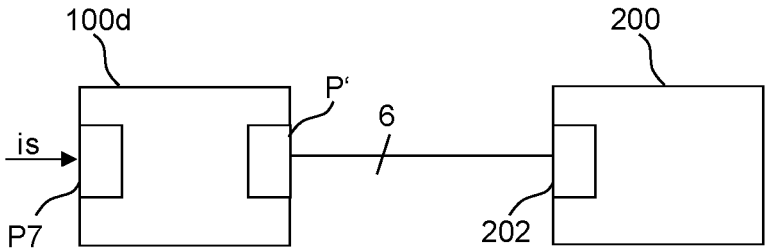

In this regard, FIG. 12 schematically depicts a simplified block diagram of an antenna 200 according to further exemplary embodiments. A phase shifter apparatus 100*d* (also cf. FIG. 6) according to exemplary embodiments is provided at its input port P7 with an input signal is and distributes the signal energy of the input signal is via the elements 140, 110', 120', 130' (FIG. 6) to its output ports P1 to P6 (also cf. reference numeral P' of FIG. 12) for forwarding to the antenna system's 200 input port 202, e.g. via six discrete RF transmission lines or cables. According to further exemplary embodiments, the apparatus 100, 100*a*, 100*b*, 100*c*, 100*d* may also be integrated into an antenna or antenna system 200.

Further exemplary embodiments relate to a use of the apparatus according to the embodiments for applying a phase shift to a radio frequency, RF, signal is, os.

Further exemplary embodiments relate to a use of the apparatus according to the embodiments for distributing an RF input signal is (FIG. 6) to a plurality of sinks P1 to P6 while applying a phase shift to said RF input signal is and/or a signal derived therefrom, e.g. by moving the slider 140 with respect to the transmission lines 110', 120', 130'.

According to further exemplary embodiments, insertion losses in dB as low as 0.73 at a frequency of 1900 MHz, 0.22 at a frequency of 2000 MHz and 0.23 at a frequency of 2200 MHz could be attained by using the apparatus 100*d*.

According to further exemplary embodiments, mechanical dimensions of said apparatus 100*d* (FIG. 6) when designed for an operation with input signals in a frequency range of about 1.9 GHz (Gigahertz) to about 2.2 GHz are about 60 mm (millimeter) (width, as e.g. seen in FIG. 6)×108 mm (height, FIG. 6). In other words, the principle according to the embodiments enables to provide compact apparatus for distributing and/or phase shifting of RF input signals is.

The apparatus described herein may be configured to operate in one or more operational frequency bands. For example, the operational frequency bands may include (but are not limited to): Long Term Evolution (LTE) (US) (734 to 746 MHz and 869 to 894 MHz), Long Term Evolution (LTE) (rest of the world) (791 to 821 MHz and 925 to 960 MHz), amplitude modulation (AM) radio (0.535-1.705 MHz); frequency modulation (FM) radio (76-108 MHz); Bluetooth (2400-2483.5 MHz); wireless local area network (WLAN) (2400-2483.5 MHz); hiper local area network (HiperLAN) (5150-5850 MHz); global positioning system (GPS) (1570.42-1580.42 MHz); US-Global system for mobile communications (US-GSM) 850 (824-894 MHz) and 1900 (1850-1990 MHz); European global system for mobile communications (EGSM) 900 (880-960 MHz) and 1800 (1710-1880 MHz); European wideband code division multiple access (EU-WCDMA) 900 (880-960 MHz); personal communications network (PCN/DCS) 1800 (1710-1880 MHz); US wideband code division multiple access (US-WCDMA) 1700 (transmit: 1710 to 1755 MHz, receive: 2110 to 2155 MHz) and 1900 (1850-1990 MHz); wideband code division multiple access (WCDMA) 2100 (transmit: 1920-1980 MHz, receive: 2110-2180 MHz); personal communications service (PCS) 1900 (1850-1990 MHz); time division synchronous code division multiple access (TD-SCDMA) (1900 MHz to 1920 MHz, 2010 MHz to 2025 MHz), ultra wideband (UWB) Lower (3100-4900 MHz); UWB Upper (6000-10600 MHz); digital video broadcasting-handheld (DVB-H) (470-702 MHz); DVB-H US (1670-1675 MHz); digital radio mondiale (DRM) (0.15-30 MHz); worldwide interoperability for microwave access (WiMax) (2300-2400 MHz, 2305-2360 MHz, 2496-2690 MHz, 3300-3400 MHz, 3400-3800 MHz, 5250-5875 MHz); digital audio broadcasting (DAB) (174.928-239.2 MHz, 1452.96-1490.62 MHz); radio frequency identification low frequency (RFID LF) (0.125-0.134 MHz); radio frequency identification high frequency (RFID HF) (13.56-13.56 MHz); radio frequency identification ultra high frequency (RFID UHF) (433 MHz, 865-956 MHz, 2450 MHz); frequency allocations for 5G, for example 600 MHz to 6 GHz and/or 24 GHz to 100 GHz.

Further aspects and advantages that may at least partly be attained with at least some exemplary embodiments are: simple structure (efficient and cost-effective manufacturing), very stable return loss over different states (cf. FIG. 8), possibility to achieve very high amount of phase shifting, relatively small in size, easy to tune, wideband solution, low insertion loss.

Figure 13:
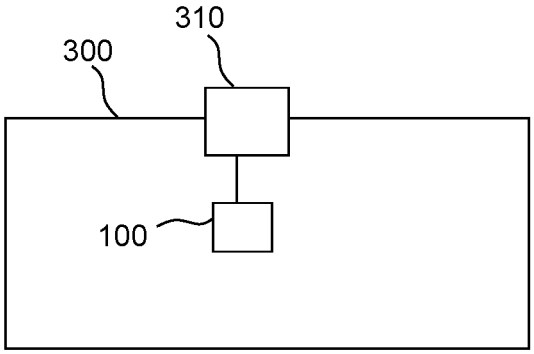

FIG. 13 schematically depicts a simplified block diagram of a base station 300 according to further exemplary embodiments. The base station 300 may e.g. be configurable to operate with a cellular mobile communications system, e.g. serving one or more terminals or user equipments or the like. The base station 300 comprises at least one antenna 310 for transmitting and/or receiving RF signals to/from other devices (other base stations, e.g. relay base stations, and/or terminals and the like) and at least one apparatus 100 according to the embodiments which may advantageously be provided for processing RF signals of said base station 300 and/or its antenna 310, e.g. as used in a transmission branch and/or a reception branch of said base station 300. As an example, according to further embodiments, apparatus 100 may be used to apply a phase shift to RF signals, which may e.g. be employed to control a beam characteristic of said antenna 310, e.g. influencing a downtilt and/or steering a spatial direction of a main lobe of said beam characteristic. Advantageously, using the apparatus 100, this can be achieved both for signals transmitted by said base station 300 or its antenna 310 and for signals received by said base station 300 or its antenna 310.

That which is claimed is:

1. An apparatus for processing radio frequency (RF) signals, wherein said apparatus comprises at least a first transmission line and a second transmission line, and an electrically conductive element that is capacitively coupled with said first transmission line and said second transmission line and that is translationally movably arranged with respect to at least one of said first transmission line and said second transmission line, wherein said electrically conductive element comprises at least one impedance transformer extending between the first and second transmission lines, wherein the at least one impedance transformer defines a longitudinal axis, wherein the at least one impedance transformer is implemented in a form of a contour discontinuity of the electrically conductive element, and wherein the contour discontinuity comprises a change in width of the at least one impedance transformer along the longitudinal axis.

2. The apparatus according to claim 1, wherein said apparatus comprises at least one further transmission line, wherein said electrically conductive element is capacitively coupled with said at least one further transmission line.

3. The apparatus according to claim 1, wherein said electrically conductive element is translationally movably arranged with respect to all transmission lines.

4. The apparatus according to claim 1, wherein at least one of said transmission lines comprises or is a) a microstrip line and/or b) a stripline.

5. The apparatus according to claim 1, wherein at least two of said transmission lines comprise different properties with respect to at least one of the following elements: a) a relative permittivity of a substrate, or b) a geometry.

6. The apparatus according to claim 1, wherein a conductor of at least one of said transmission lines is embedded into a dielectric substrate.

7. The apparatus according to claim 1, wherein at least one of said transmission lines and/or a conductor of at least one of said transmission lines comprises a curved or meandered section.

8. The apparatus according to claim 1, wherein said transmission lines are arranged in a same first virtual plane, and wherein said electrically conductive element is arranged within a second virtual plane which is at least substantially parallel to said first virtual plane.

9. The apparatus according to claim 1, wherein a) said electrically conductive element comprises a port for receiving an input signal, and/or b) at least one of said transmission lines comprises at least one port for output of at least one respective output signal depending on said input signal.

10. An antenna comprising at least one apparatus according to claim 1.

11. A base station comprising at least one antenna and at least one apparatus, wherein the apparatus comprises at least a first transmission line and a second transmission line, and an electrically conductive element that is capacitively coupled with said first transmission line and said second transmission line and that is translationally movably arranged with respect to at least one of said first transmission line and said second transmission line, wherein said electrically conductive element comprises at least one impedance transformer extending between the first and second transmission lines, wherein the at least one impedance transformer defines a longitudinal axis, wherein the at least one impedance transformer is implemented in a form of a contour discontinuity of the electrically conductive element, and wherein the contour discontinuity comprises a change in width of the at least one impedance transformer along the longitudinal axis.

12. The base station according to claim 11, wherein said apparatus comprises at least one further transmission line, wherein said electrically conductive element is capacitively coupled with said at least one further transmission line.

13. The base station according to claim 11, wherein said electrically conductive element of said apparatus is translationally movably arranged with respect to all transmission lines.

14. The base station according to claim 11, wherein at least one of said transmission lines of said apparatus comprises or is a) a microstrip line and/or b) a stripline.

15. The base station according to claim 11, wherein at least two of said transmission lines of said apparatus comprise different properties with respect to at least one of the following elements: a) a relative permittivity of a substrate, or b) a geometry.

16. The base station according to claim 11, wherein a conductor of at least one of said transmission lines of said apparatus is embedded into a dielectric substrate.

17. A method of operating an apparatus for processing radio frequency (RF) signals, the method comprising:

providing the apparatus comprising at least a first transmission line and a second transmission line, and an electrically conductive element that is capacitively coupled with said first transmission line and said second transmission line and that is translationally movably arranged with respect to at least one of said first transmission line and said second transmission line, wherein said electrically conductive element comprises at least one impedance transformer extending between the first and second transmission lines, wherein the at least one impedance transformer defines a longitudinal axis, wherein the at least one impedance transformer is implemented in a form of a contour discontinuity of the electrically conductive element, and wherein the contour discontinuity comprises a change in width of the at least one impedance transformer along the longitudinal axis;

providing an RF signal as an input signal to said electrically conductive element, and moving said electrically conductive element relative to said at least one of said first transmission line and said second transmission line.

18. The method according to claim 17, wherein moving said electrically conductive element comprises applying a phase shift to the RF signal.

* * * * *